US010841982B2

(12) United States Patent
Sedarous

(10) Patent No.: US 10,841,982 B2
(45) Date of Patent: Nov. 17, 2020

(54) PAINTABLE SURFACE HEATING SYSTEM USING GRAPHENE NANO-PLATELETS APPARATUS AND METHOD

(71) Applicant: Salah S. Sedarous, Rochester, MN (US)

(72) Inventor: Salah S. Sedarous, Rochester, MN (US)

( * ) Notice: Subject to any disclaimer, the term of this patent is extended or adjusted under 35 U.S.C. 154(b) by 316 days.

(21) Appl. No.: 15/789,152

(22) Filed: Oct. 20, 2017

(65) Prior Publication Data

US 2018/0063889 A1 Mar. 1, 2018

Related U.S. Application Data

(60) Provisional application No. 62/410,698, filed on Oct. 20, 2016.

(51) Int. Cl.
*H05B 3/12* (2006.01)
*H05B 3/34* (2006.01)
(Continued)

(52) U.S. Cl.
CPC ..... *H05B 3/12* (2013.01); *B05D 1/02* (2013.01); *H05B 3/03* (2013.01); *H05B 3/145* (2013.01); *H05B 3/20* (2013.01); *H05B 3/34* (2013.01); *H05B 3/60* (2013.01); *H05B 3/78* (2013.01); *H05B 2203/013* (2013.01);
(Continued)

(58) Field of Classification Search
CPC ... H05B 3/12; H05B 3/78; H05B 3/20; H05B 3/145; H05B 3/34; H05B 3/60; H05B 3/03; H05B 3/18; H05B 3/28; H05B 3/26; H05B 2214/04; H05B 2214/02; H05B 2203/026; H05B 2203/013; H05B 2203/017; H05B 2203/00704; B05D 1/02; B64D 15/12;
(Continued)

(56) References Cited

U.S. PATENT DOCUMENTS 4,115,917 A 9/1978 Charon et al.
8,048,214 B2 11/2011 Prud et al.
(Continued)

FOREIGN PATENT DOCUMENTS

DE 202010009208 U1 10/2010

OTHER PUBLICATIONS

Karim, et al., "Graphene-based surface heater for de-icing applications", RSC Adv., 2018, 8, 16815, USA., May 8, 2018.
(Continued)

*Primary Examiner* — Shawntina T Fuqua
(74) *Attorney, Agent, or Firm* — Richard E. Billion; Billion & Armitage

(57) ABSTRACT

A heating device including a substrate, at least one heating layer on the substrate, and a power supply electrically connected to the at least one heating layer. The heating layer includes graphene nanomaterials. To form a layer of heating material, a liquid including graphene nanomaterials is applied to the substrate. The liquid is dried to form the at least one heating layer on the substrate. A first electrode and a second electrode are attached to the substrate. A power supply is electrically connected to the at least one heating layer on the substrate via the first electrode and the second electrode. The heating layer produces heat in the presence of power applied to the electrodes.

20 Claims, 8 Drawing Sheets

(52) U.S. Cl.
CPC .... *H05B 2203/026* (2013.01); *H05B 2214/02* (2013.01); *H05B 2214/04* (2013.01)

(58) Field of Classification Search
CPC .... B64D 45/02; H02H 1/04; Y10T 29/49083; C01B 32/158; C01B 32/168; C01B 32/194
See application file for complete search history.

(56) References Cited

U.S. PATENT DOCUMENTS 9,233,850 B2 * 1/2016 Jang ..... B82Y 30/00
9,918,356 B2 3/2018 Althaus
2014/0151353 A1 * 6/2014 Steinwandel ..... B64D 15/12 219/202
2015/0337145 A1 * 11/2015 Torrisi ..... C09D 11/037 428/207

OTHER PUBLICATIONS

Shin, et al., "High electrothermal performance of expanded graphite nanoplatelet-based patch heater", J. Mater. Chem., 2012, 22, 23404, 2012, USA., Sep. 20, 2012.
Song, et al., "Inkjet printing of single-walled carbon nanotubes and electrical characterization of the line pattern", Nanotechnology, vol. 19, No. 9, 2008, USA., Feb. 12, 2008.
Zhang, et al., "High-yield ball-milling synthesis of extremely concentrated and highly conductive graphene nanoplatelet inks for rapid surface coating of diverse substrates", Carbon 120 (2017) 411-418, USA., May 19, 2017.

* cited by examiner

PAINTABLE SURFACE HEATING SYSTEM USING GRAPHENE NANO-PLATELETS APPARATUS AND METHOD

TECHNICAL FIELD

Various embodiments described herein relate to an apparatus for a paintable surface heating system using graphene nano-platelets. Other various embodiments relate to methods for making and using the paintable surface heating system.

SUMMARY OF THE INVENTION

A device includes a heating surface element made of a paint that includes a nanomaterial substance. One such substance is Graphene Nano-platelets ("GNP"). GNP has a very high electrical conductivity and a very high thermal conductivity when compared to many other substances. The use of GNP provides highly uniform surface temperature.

BRIEF DESCRIPTION OF THE DRAWINGS

The invention is pointed out with particularity in the appended claims. However, a more complete understanding of the present invention may be derived by referring to the detailed description when considered in connection with the figures, wherein like reference numbers refer to similar items throughout the figures and:

The description set out herein illustrates the various embodiments of the invention and such description is not intended to be construed as limiting in any manner.

DETAILED DESCRIPTION

Figure 1:
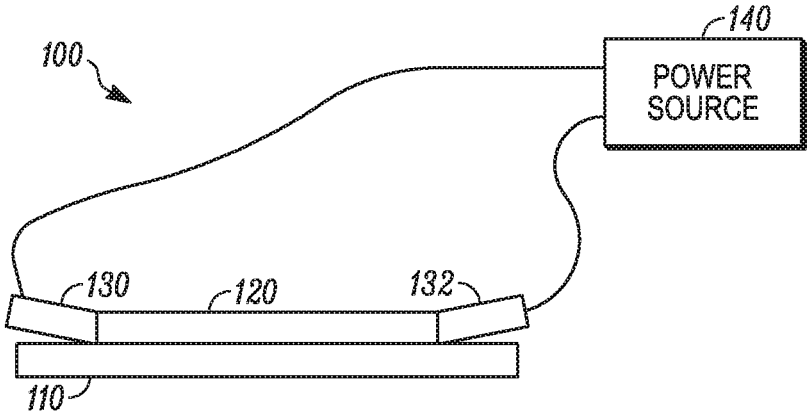
FIG. 1 is a schematic view of a heating apparatus, according to an example embodiment.

FIG. 1 is a schematic view of a heating apparatus 100, according to an example embodiment. The heating apparatus 100 includes a substrate 110, and a layer of electrically conductive paint or ink 120. The beating apparatus 100 can also include a first electrode 130 and a second electrode 132. The first electrode 130 and the second electrode 132 are generally positioned remote from one another with a portion of electrically conductive paint or ink 120 located between them. A source of power 140 is attached to the first electrode 130 and the second electrode 132. The power source 140 drives electrical energy through the layer of electrically conductive paint or ink 120. Heat is produced at the layer 120. The heating apparatus 100 is sometimes referred to as a conductive surface heater. The power source 140 can be either an AC or DC power supply. The DC power supplies would work for low-temperature applications, and the AC power supplies are suitable for high-power heating source and or for high-temperature applications.

Figure 2:
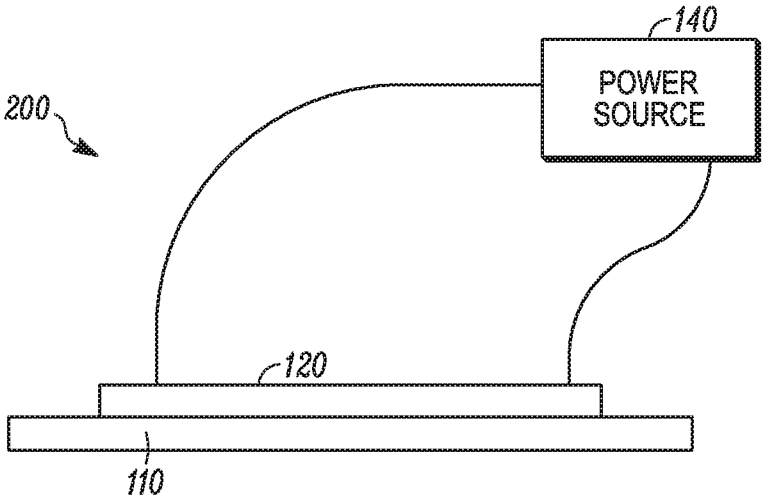
FIG. 2 is a schematic view of another heating apparatus, according to another example embodiment.

FIG. 2 is a schematic view of another heating apparatus 200, according to another example embodiment. The heating apparatus 200 includes many of the same elements of the heating apparatus 200. The common elements carry the same reference numbers. For the sake of brevity, some of the differences will be discussed. In the heading apparatus 200, the main difference is that the heating apparatus is devoid of electrodes. The power source can be connected to selected portions of the surface 120. Generally, the power source is connected at two spots that are remote horn one another. Electricity flows in the electrically conductive paint or ink 120 to produce heat. The power source can be connected at other spots on the electrically conductive paint or ink 120 to produce heat. In another example embodiment, there are no separate electrodes. The heating apparatus 200 is sometimes referred to as a conductive surface heater.

The electrically conductive paint or ink of nanosubstance 120 includes an electrically conductive and thermally conductive nanomaterial such, as Graphene Nano-platelets (GNP). The electric power source 140 is connected to two ends of a surface area to provide an electric current and power to the heater 100, 200. The conductive surface heater can take any shape or thickness. A heater that is graphene-based provides a large uniform surface temperature due to the intrinsic high lateral thermal conductivity of GNP. The electrically conductive surface heaters can replace wire-based heating coils and therefore would have numerous applications. For example, the device can be used as a heating element in home appliances such as in replacing the heating elements of furnaces, space heater, clothes dryers, and even in the heating elements of coffee makers and water heaters. It can also be used for heating electronics and other applications where external heat is needed. In cold climates locations, the surface heaters can be used in outdoor applications such as in defrosting driveways, highways exit/enter ramps, streets sideways, and runways of airports. Other applications besides theses are contemplated.

Figure 3:
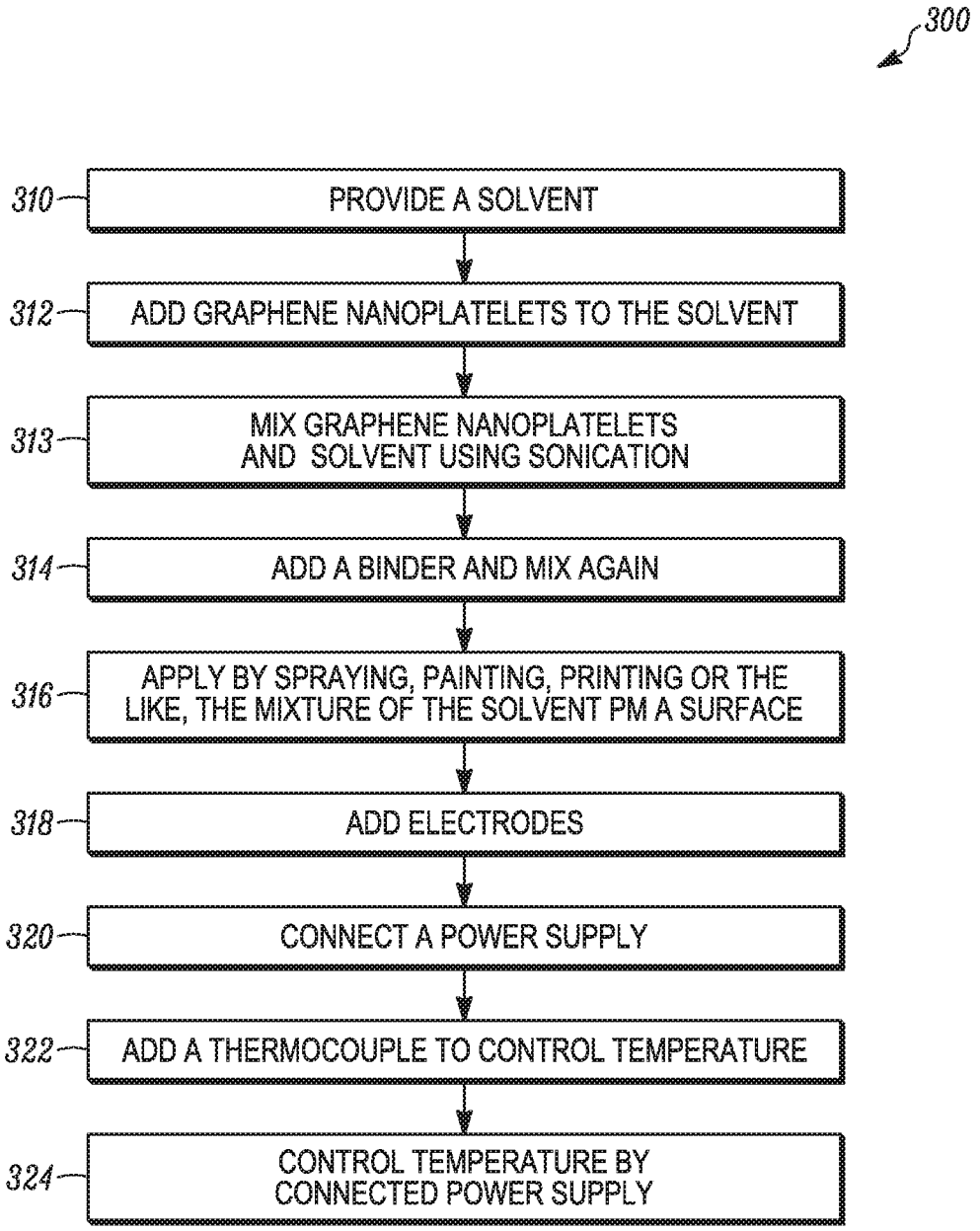
FIG. 3 is a flow chart of a set of processes for making a GNP heater on a substrate, according to an example embodiment.

FIG. 3 is a flowchart of a method 300 for making a GNP heater on a substrate, according to an example embodiment. The method 300 can also be thought of as a set of processes for making the GNP heater on a substrate. The method 300 includes providing a solvent 310, and adding graphene nano-platelets to solvent 312. The graphene nano-platelets and solvent are mixed using sonication 313. Sonication is the act of applying sound energy to agitate particles in a sample. Ultrasonic frequencies are used in some embodiments. The method 300 also includes adding a binder 314 and sonicates the mixture. The mixture of the solvent, the graphene nano-platelets, and the binder is applied to a surface or a substrate 316. The mixture is applied by spraying, painting, printing or the like, the mixture of the solvent, the graphene nano-platelets and the binder onto a surface or substrate. Metal electrodes, in some embodiments, are added 318, and a power supply is electrically connected to the electrodes 320. In some embodiments, a thermocouple is added 322 to control temperature. The method 300 further includes using the connected power supply to control temperature 324.

In making the paint, that includes a solvent and graphene nano-platelets, the unique size and platelet morphology of GNP make these particles especially effective at providing barrier properties, while their pure graphitic composition makes them excellent electrical and thermal conductors. Unlike many other additives, GNP can improve the mechanical properties of the paintable heater, such as stiffness, strength and surface hardness.

Moreover, the ease by which a paint can be applied to diverse substances and surfaces can be used in making efficient heating devices provided that an electric source and electrodes are present. Paintable heating devices can lead to the development of many applications such as a two-dimensional heating device made of paints or coating of GNP in different binders, matrix materials and surfactants. The different binders, matrix materials and surfactants or solvents can be varied to design the paint or ink for specific applications depending on the desired final temperature and or for the environment in which the ink or paint will operate in. The conductive surface area is connected to electrodes at their terminals which are hence also connected to an electric power supply. The current flowing across the conductive paint heats the object while the predetermined final temperature is controlled by the use of a surface thermocouple, which controls the magnitude of current to the device and hence the amount of heat produced which in turn affects the temperature of the device.

Figure 4:
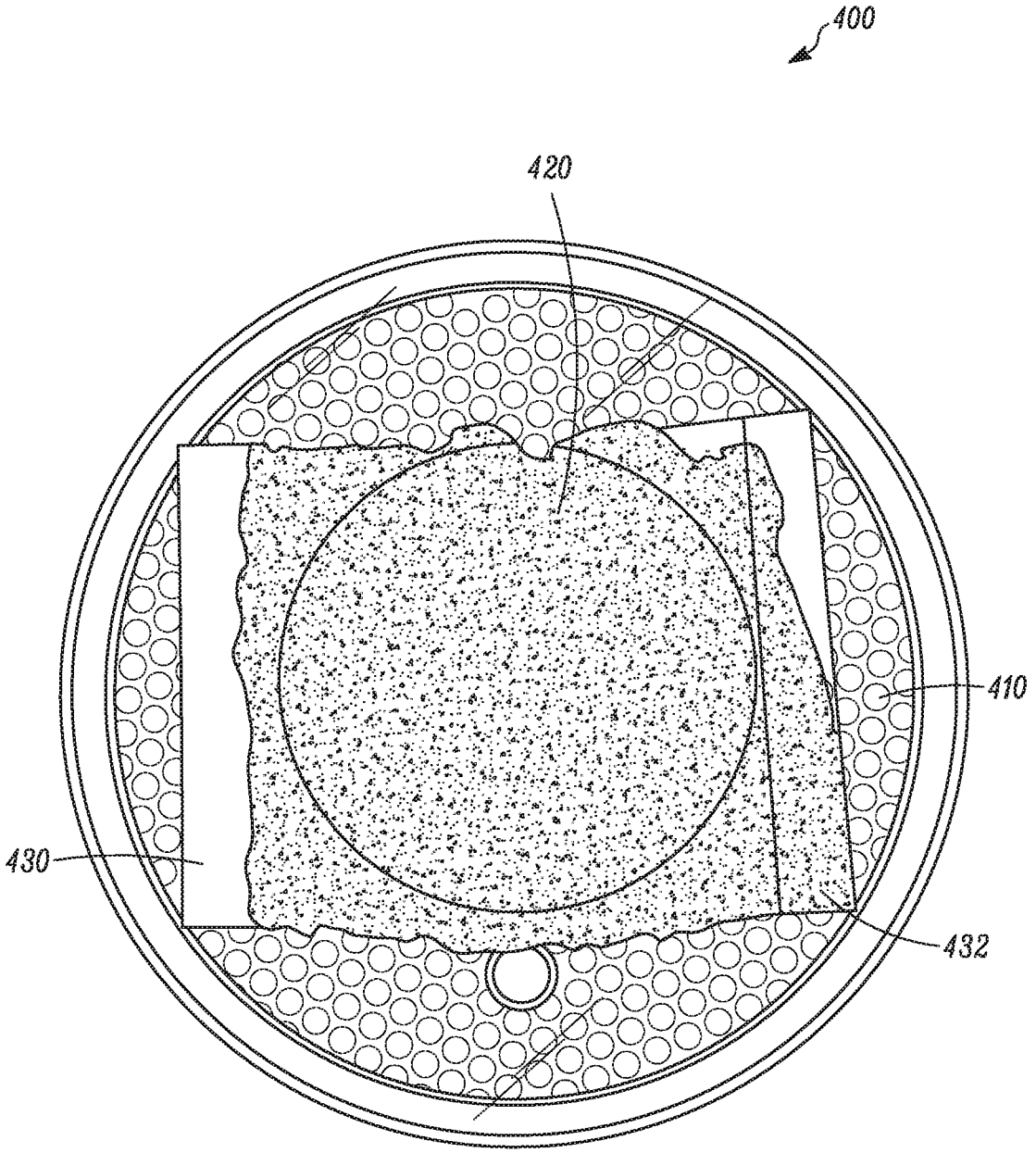
FIG. 4 is a top view of a GNP heater over glass substrate with copper electrodes, according to an example embodiment.

FIG. 4 is a top view of a GNP heater 400 formed over a glass substrate 410 with copper electrodes 430, 432, according to an example embodiment. The paint or ink is formed with GNP therein. The paint or ink is a solvent or surfactant that has GNP mixed therein. The paint or ink is also provided with a binder. The paint or ink is formed so that it can be sprayed or printed onto the substrate 410 to form a thin film or layer of heater material 420. The paint or ink is sprayed, printed, or otherwise applied to the material. Electrodes 430 and 432 are added to the ends of the sprayed or printed material. A power supply (shown in FIGS. 1 and 2) is then applied to the electrodes 430, 432. A thermocouple can be used to control the magnitude of the current applied to the electrodes 430, 432 and the heater material 420 as applied to the substrate 410.

Figure 5:
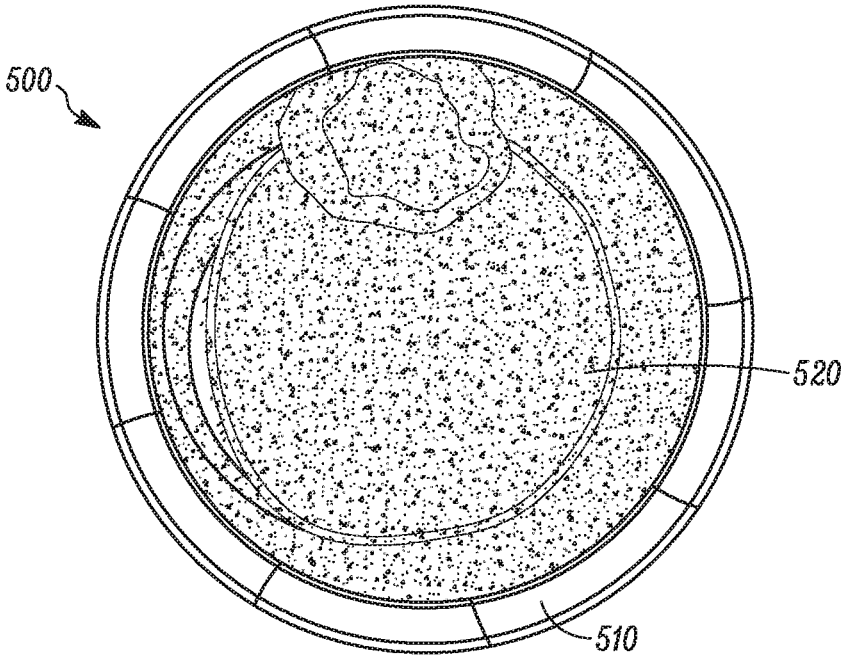
FIG. 5 is a top view of a GNP heater on glass without copper electrodes, according to an example embodiment.

FIG. 5 is a top view of a GNP heater 500 formed on glass without copper electrodes, according to an example embodiment. The paint or ink is formed with GNP therein. The paint or ink is a solvent or surfactant that has GNP mixed therein. The paint or ink is also provided with a binder. The paint or ink is formed so that it can be sprayed or printed onto the substrate 510 to form a thin film or layer of heater material 520. The paint or ink is sprayed, printed, or otherwise applied to the material. A power supply (shown in FIGS. 1 and 2) is then applied to the heater material 520 at two locations remote from one another. A thermocouple can be used to control the magnitude of the current applied to the heater material 520 as applied to the substrate 510.

Figure 6:
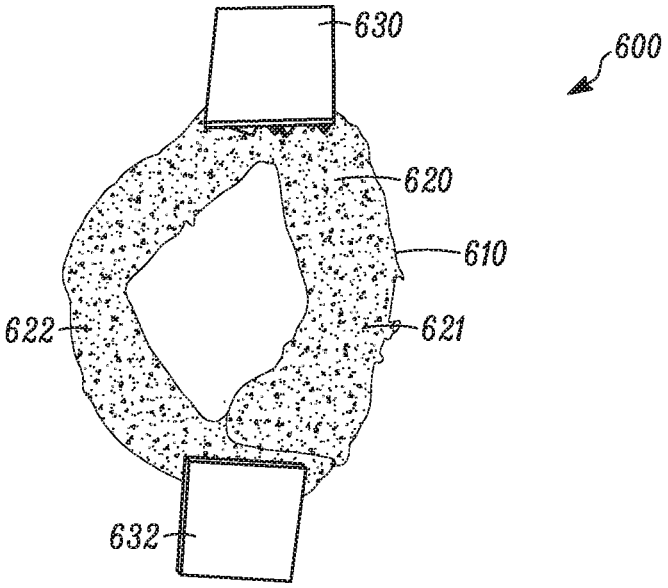
FIG. 6 is a top view of GNP heater of two channels on Pyrex substrate, according to an example embodiment.

FIG. 6 is a top view of GNP heater 600 of two channels on Pyrex substrate 610, according to an example embodiment. The paint or ink is formed with GNP therein. The paint or ink is a solvent or surfactant that has GNP mixed therein. The paint or ink is also provided with a binder. The paint or ink is formed so that it can be sprayed or printed or otherwise applied onto the Pyrex substrate 610 to form a thin film or layer of heater material 620. In this embodiment, the heater material 620 is formed as a first channel 621 and a second channel 622. The channel 621 and the channel 622 are isolated from one another along a portion of their respective paths. The paint or ink is sprayed, printed, or otherwise applied to the material. Electrodes 630 and 632 are added to the ends of the sprayed or printed material 620. A power supply (shown in FIGS. 1 and 2) is then applied to the electrodes 630, 632. A thermocouple can be used to control the magnitude of the current applied to the electrodes 630, 632 and the heater material 620 as applied to the substrate 610.

Figure 7:
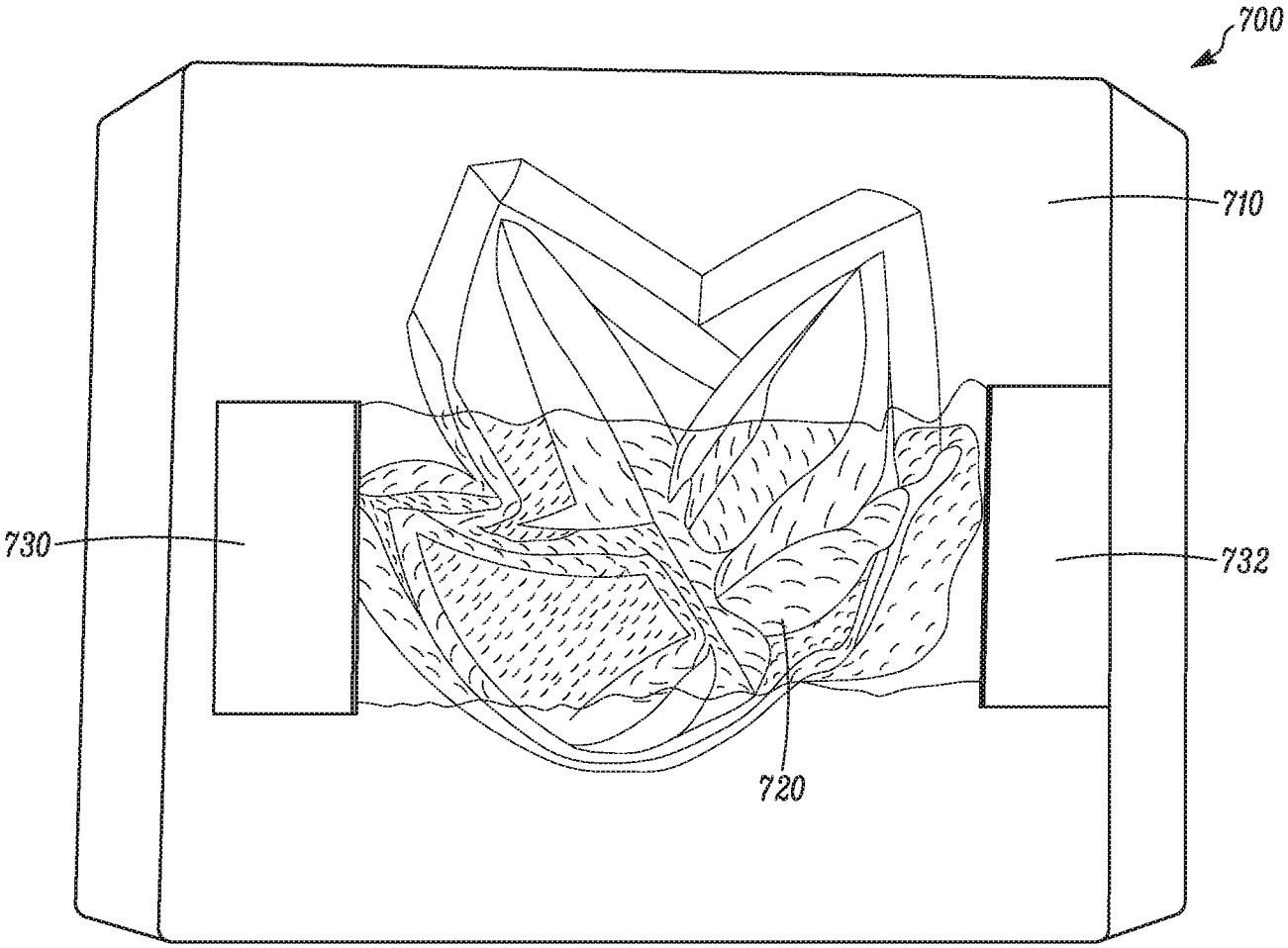
FIG. 7 is a top view of a GNP heater on a wood substrate with copper electrodes, according to an example embodiment.

FIG. 7 is a top view of a GNP heater 700 on the wood substrate 710 with copper electrodes 730, 732, according to an example embodiment. The paint or ink is formed with GNP therein. The paint or ink is a solvent or surfactant that has GNP mixed therein. The paint or ink is also provided with a binder. The paint or ink is formed so that it can be sprayed or printed onto the wood substrate 710 to form a thin film or layer of heater material 720. The paint or ink is sprayed, printed, or otherwise applied to the material. Electrodes 730 and 732 are added to the ends of the sprayed or printed material. A power supply (shown in FIGS. 1 and 2) is then applied to the electrodes 730, 732. A thermocouple can be used to control the magnitude of the current applied to the electrodes 730, 732 and the heater material 720 as applied to the substrate 710.

Figure 8:
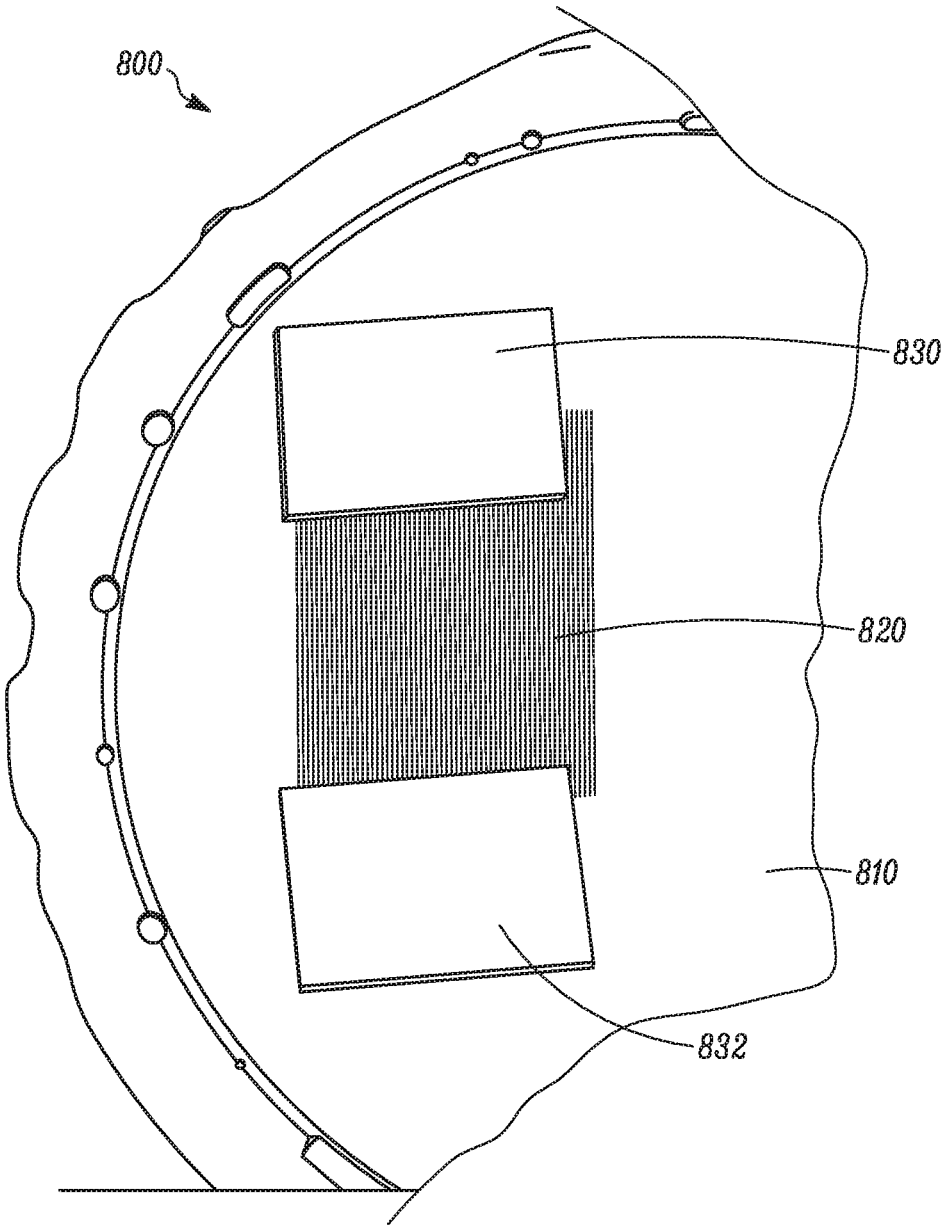
FIG. 8 is a top view of a GNP heater on a cement block with copper electrodes, according to an example embodiment.

FIG. 8 is a top view of a GNP heater 800 on cement block substrate 810 with copper electrodes 830, 832, according to an example embodiment. The paint or ink is formed with GNP therein. The paint or ink is a solvent or surfactant that has GNP mixed therein. The paint or ink is also provided with a binder. The paint or ink is formed so that it can be sprayed or printed onto the substrate 810 to form a thin film or layer of heater material 820. The paint or ink is sprayed, printed, or otherwise applied to the material. Electrodes 830 and 832 are added to the ends of the sprayed or printed material. A power supply (shown in FIGS. 1 and 2) is then applied to the electrodes 830, 832. A thermocouple can be used to control the magnitude of the current applied to the electrodes 830, 832 and the heater material 820 as applied to the substrate 810.

Figure 9:
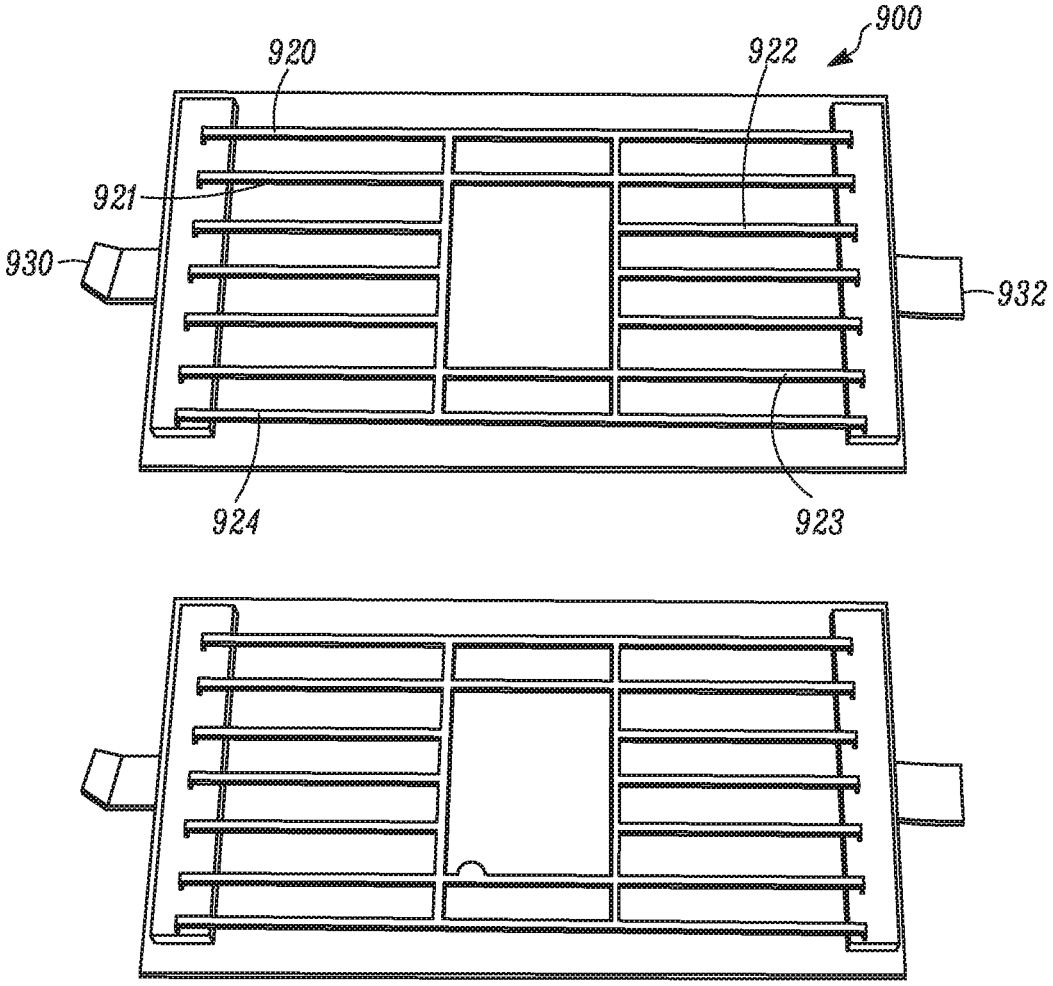
FIG. 9 is a top view of a Ceramic tile with painted GNP heater, according to an example embodiment.

FIG. 9 is a top view of a Ceramic tile with painted GNP heater 900, according to an example embodiment. The GNP heater 900 is formed on a substrate 910 with copper electrodes 930, 932, according to an example embodiment. The paint or ink is formed with GNP therein. The paint or ink is a solvent or surfactant that has GNP mixed therein. The paint or ink is also provided with a binder. The paint or ink is formed so that it can be sprayed or printed onto the substrate 910 to form a thin film or layer of heater material 920. The paint or ink is sprayed, printed, or otherwise applied to the material. In this embodiment, the heater material is formed as a plurality of separated channel 921, 922, 923, 924. Electrodes 930 and 932 are added to the ends of the sprayed or printed material. A power supply (shown in FIGS. 1 and 2) is then applied to the electrodes 830, 932. A thermocouple can be used to control the magnitude of the current applied to the electrodes 930, 932 and the heater material 920 as applied to the substrate 910.

Still other embodiments include a heater that has a plurality of painted or printed heater layers on a substrate. Further embodiments include:

The heating device discussed above having graphene nano-platelets Oxide or edge-functionalized graphene nano-platelets. In addition, the heating device could be formed with of exfoliated graphite exfoliated graphite oxides. In other example embodiments, the heating device can be made using any/and all two-dimensional nanomaterials of high electrical conductivity.

The substrate used can include polymers of high glass transition, glass, metals, Pyrex, cement, concrete, wood, ceramics, a variety of tile materials, an electrically conductive material, an electrically isolated material, a mechanically strong material, a flexible material, a porous material, a nonporous material.

It is further contemplated that the paint could be oil based or acrylic paint. In one embodiment, graphene nano-platelets in an oil-based or acrylic paint could contain 0.1% to 1% graphene nano-platelets by weight. The amount of graphene nano-platelets can be higher than 1% or lower than 0.1% of nanomaterials depending on the expected final operating temperature of the heater. The graphene nano-platelets could be used with a pigment, a binder, a resin, an extender, a solvent or a thinner of either an organic solvent or water and additives. In one embodiment, graphene nano-platelets are initially dissolved in thinner before adding it to an over the shell paint. The paint can be applied as a spray on substrates, printed on the substrates, applied in a 3-d printing operation, or as rollover printings.

The liquid heating device using graphene nano-platelets can be incorporated with cement to defrost driveways of houses and highways, runways of airports, highway bridge decks in cold climates. The heaters could also be used as the heating source of home furnaces. The heaters could also be used as the heating source of home tiles. Also contemplated is a heating device as described above to be used for outdoor applications by attaching it to an energy source of a solar panel.

Various implementations and testing procedures for the GNP surface heater are illustrated in the following examples.

EXAMPLE 1

Materials: GNP (xGnp-M-5) was purchased from XG Sciences and was used without further modifications GNP was dispersed in Isopropanol Alcohol using probe sonication. A glass plate was used as an example of a testing surface. The Glass surface was chemically etched with concentrated sulfuric acid for 5 minutes followed by multiple washes with deionized (DI) water to remove all traces of the acid.

A rectangular heater of a GNP strip was painted on the glass using a brush. At the ends of the strip were placed a copper foil tape as electrodes. The rectangular paint overlapped with the copper electrodes to form an ohmic contact with the surface heater. The copper created low resistance contacts for the electric inputs.

The GNP heater was electrified to test their heating properties. A direct current power supply (25V, 0.9 Am) was used to supply the input power. The current in the circuit was measured using a CEN-Teck power meter. The initial sheet resistance between the two electrodes was 13 Ohm at room temperature (22 C). Upon applying an external 25 volts to the electrodes, a temperature rise to around 68 C after 60 seconds of active current was observed. The temperatures of different spots on the heater surface were measured using a non-contact laser thermometer. Also observed was a rapid drop (tens of seconds) in temperature when the electric source was disconnected. The rapid drop in the temperature of the GNP heater is due to the high lateral thermal conductivity of graphene.

EXAMPLE 2

Another heater sample was tested using different graphene preparation.

Materials: Graphene sample was chemically processed to increase exfoliation of the nano-platelets under basic pH condition. A 3% hydrogen peroxide was added slowly to the graphene solution while mixing and was kept at room temperature for 24 hours. The sample was filtered and washed multiple times with deionized ("DI") water to remove salts and ions until the pH of the solution dropped to around pH 7. An ink solution of the exfoliated sample was made with the addition of a Gum Arabic binder without further modification to paint a new glass plate of circular surface shape.

Two electrodes were placed at opposite end of the circle while measuring the surface resistance between the two electrodes. A current was also applied to the painted film and the temperature rise was measured at different locations on the glass heater. The GNP paint film was stable even in the absence of binders even after heating events. Again we noticed a rapid rise in temperature of the glass surface.

The GNP film was painted on a variety of surface substrates of different materials such on Pyrex (FIG. 6), plastic, paper, wood block (FIG. 7), and cement slab (FIG. 8). In all examples, the same rapid rise in sample's temperature followed by lateral spreading of heat on the surface was observed. The rate at which temperature increases depends on the electrical resistance of the film (between electrodes). The lateral temperature equilibrium on the surface is related to the concentration of GNP, their microscopic orientation across (effective thermal conductivity), and the material composition of the substrate.

EXAMPLE 3

The performance of GNP painted heater on cement substrate of 0.3 cm thickness of the middle section and 0.6 cm at one side of its boundary (FIG. 8) was tested. Using a rectangular shape GNP coat on cement a rapid rise in temperature of the substrate (280 C) with the applied electric source was observed. In this example, the initial electrical resistance of the device as measured at both ends of the coat was around 40 ohm. The temperature rise of the surface area of the cement was more noticeable at the edge of the cement slab. It is also important to notice that the cement sample that used contained less than 1% of GNP in its composition, which contributed to the enhancement of the thermal conductivity of the cement surface. However, the electrical conductivity of the cement was very small and much less than the detection limit of the instrument. The instrument indicated that current remained within the GNP heater.

Figure 10:
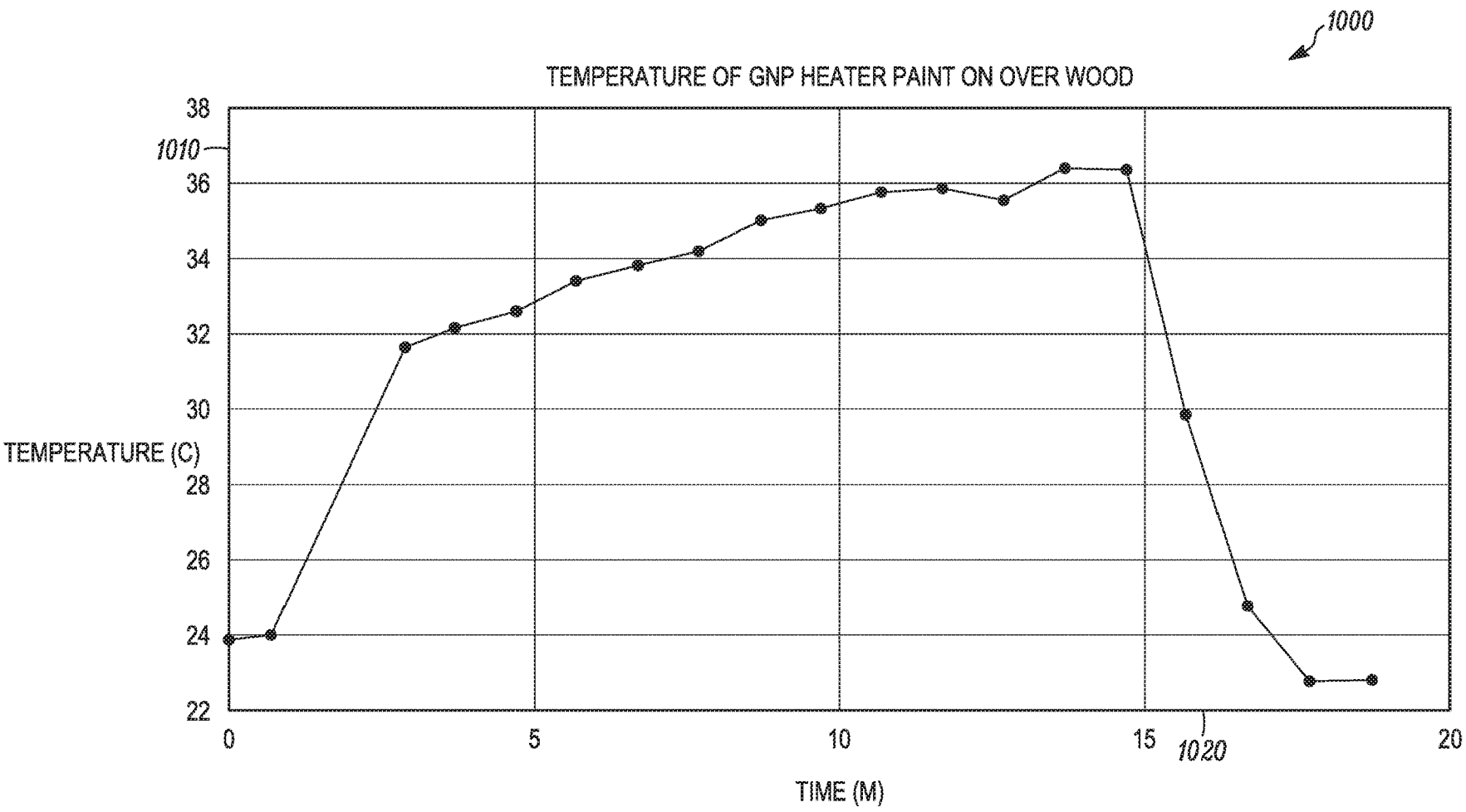
FIG. 10 is a graph of a temperature profile of the GNP heater on a wood substrate of FIG. 7, according to an example embodiment.

The heating profile of GNP painted heater on wood (FIG. 7) is illustrated in FIG. 10. As expected, the temperature increase is not as much as that of other substrates. FIG. 10 is a graph of a temperature profile of the GNP heater on a wood substrate of FIG. 7, according to an example embodiment. In the graph, the temperature is on the vertical or y-axis 1010 and the time in minutes is on the horizontal or x-axis 1020. As shown, the temperature rises during an initial time and then drops rapidly after several minutes when the current is removed from the heater 700.

A comparison with other types of materials:

In order to test the performance of Graphene heater in compati son to other carbon materials, a heater paint made of conductive wire glue available from Radio Shack was tested. The RadioShack Graphite-Filled Conductive Wire Glue contains black carbon pigment. The electrical resistance of a rectangle strip of the black ink of 3 by 3 cm indicates an electrical resistance of around 1.04 M Ohms. When this heating device was connected to an electrical source, no heating at all was observed. The lack of heating in this system reflects the high resistivity of the black carbon and its matrix in comparison to GNP systems.

In summary, the platform technology of this application is for a paintable heater. This means that a material can be spread on any surface in the form of a paint, ink or suspension, to form a film which upon drying becomes an electrically resistive film. When current is run through the film, it becomes a heater.

A sample preparation includes suspending 2 grams of graphene nano-platelets, such as M-5 from XG Sciences, 3101 Grand Oak Drive, Lansing, Mich. 48911, in 250 ml of water. The suspension is sonicated for a total of 20 minutes with 1 minute on followed by 20 seconds off cycle. Then 5 ml of 93% Sulfuric acid was slowly added to the suspension and mixed well. After mixing, we slowly added 10 ml of 3% hydrogen peroxide to further exfoliate the graphene nano-platelets. The solution was continuously mixed for 10 minutes and then stored in a cold place. The mix was left alone for a few days. After the few days, the mix is then diluted with 1 to 5 in volume with deionized (di) water. The solution was allowed to settle and the acid was washed three times by di water. After removing excess water, the suspended nano-platelets are again resuspended in 200 ml of fresh water. The final suspension was made acidic by adding a 10 ml of Acetic acid and used as is.

In another sample preparation, the M-5 graphene nano-platelet was suspended at a concentration of 2 g/250 ml of 91% Isopropyl Alcohol using a probe sonicator, 200 W, and used as received.

In yet another different sample preparation, a mortar and pestle are used to grind 0.5 grams of M-5 graphene nano-platelets. Once the graphene is a fine even powder, we slowly added a 10 ml of di water to the dry powder and continue the grinding process to remove any lumps until we obtained a fine paste. In a separate container, egg tempera was prepared using only the yolk of a fresh egg that is diluted with equal amount of di water. A few drops of Acetic acid is added to the yolk mix for preservation. A small amount of the graphene paste is slowly mixed with equal amount of the yolk paste to form the final paint. The concentrated tempera/graphene mix is then applied to the substrate to form the heating surface. Two copper electrodes were used on the opposite sides of the film and the dry resistance between them is measured. If the resistance is high, more applications are added until we reached the desired resistance.

Still another sample preparation method for graphene nano-platelet paint or graphene nano-platelet ink includes the dispersion of xGnP R-7 from XG Sciences, 3101 Grand Oak Drive, Lansing, Mich. 48911, USA in water glass matrix. A 20 grams of Water glass sample from Rutland Fire Clay Co., 38 Merchants Row, Rutland, Vt., 05701 USA, was used as received. It was first diluted with 20 grams of water before adding 2 grams of xGnP R-7 to the mix. The mix was vigorously shaken in a tightly covered 100 ml container for a few minutes before its use. In another preparation, the graphene in water glass system was dispersed using a probe sonicator to obtain a better dispersal. After mixing, the graphene sample was painted on ceramic tile that contained copper electrodes at the two opposite edges using a hand brush. The sample was left to dry at room temperature for 24 hours. The electric resistance of the dry film between the two electrodes was measured with an electric meter. The application of new wet film, drying, and the measurements of the electric resistance were repeated over a few days in order to lower the final resistance. The resistance of the film decreased with the increasing number of film applications. Once the desired resistance or heating power is reached, no new film was added. The value of the heating power of the film is related to its final resistance and the applied external voltage, $P=V^2/R$, where R is the final resistance and V is the applied voltage.

Assuming the formation of a uniform resistive surface, there is a relationship between the total resistance and the power generation as in the following P=V~2/R, where V is the applied voltage and the R is the electrical resistance. It is clear that generating a high-power heating source requires film with low resistance or the use of a high external voltage source. The power density for square length can be calculated by normalizing the total two-dimensional lengths to the specific area of interest.

The above can be used as paints or inks.

It should be understood that enhancements to the physical and chemical properties of GNP and derivatives for this application are contemplated. It should be noted that other electrically conductive inks and paints could be utilized or modified for the heating applications like those described above. In addition, it is contemplated that these inks and coatings can be used and may work in diverse synthetic polymers. However, the different glass and melting temperatures of the different polymers have to be considered when contemplating heaters that can bind to these substrates while provides heating without damaging or altering the physical or chemical properties of these materials. In some embodiments, the graphene paint could be placed or sandwiched between two polymers matrices and be used as a conductive heating element. In still further example embodiments, the polymer layers and the graphene paint can be layered so that multiple layers of graphene paint or film can be sandwiched between adjacent layers of polymer. When sandwiched between tow polymer matrices, the graphene paint can be used as a conductive heating element, such as those described at other locations in this application.

A large number of specific applications for the above-described heaters is contemplated. Some of the specific applications are listed below. It should be noted that this list is not inclusive but is a sampling of a large number of possible applications of the heater invention.

Outdoor:

The heating device can be implemented in flexible long strips, which can be enclosed into or under modern concrete or cement composition of smart driveways. These heating elements can provide external heat during winter seasons which can be implemented in the following:

- Defrosting driveways by applying painting strips of electric heating elements under driveways for defrosting.
- Defrosting busy streets and sideways to prevent the formation of Ice on the roads.
- Defrosting runways in airports by applying of painting strip of electric heaters under runways and therefore reduces plans slipping or gliding on runways.
- Heating blanket for outdoor applications or construction in which the temperature of outdoor objects needs to stay above a specific temperature.
- The increased production of renewable solar energy can directly be used as a local and alternative energy source for outdoor surface heating. One can think of many other applications for the use of GNP surface heaters in addition to ones mentioned here.
- Outer space: The two-dimensional surface heater can be used in special applications such as in space environments by designing an on-demand heater for the specific target by simply apply the coating to any element followed by activating the heating surface with an electric source. Giving the extreme cost of bringing heavyweights electric coils and metals to space orbits, one can easily replace many of these with a much lighter container of GNP conductive paint that can be transformed into any types of heaters as long there is an electric power source. Heating construction and deconstruction are easy to implement in these circumstances since the same heater can be erased using chemicals such as alcohol once the heating device is not needed.

Indoor:

Heating blankets for home and hospital usages.

The electric heating surface can be used in any application that requires the use of strong heating sources such as water heaters and coffee makers. Having the heating source in close contact with the object of heating reduces the thermal resistance and therefore provides an efficient heating source.

Floor heating: The graphene heating coats can be incorporated into ceramic tiles by sandwiching them as a conductive film within the content of tiles. By connecting numbers of graphene modified tiles to an electric source, one can create a heated floor with little modification of existing construction by using an electric source, thermocouples and thermostat to control the final temperature. This technique can reduce the building cost and minimizes the complexity of the design since there are no needs for an external ventilation system as in the case of gas heating systems. Moreover, they can be easily added, for example, to any existing bathroom by just changing the tiles to heat their floor without too many modifications of a given home design. Using GNP modified tiles is much affordable and easier to implement than using Carbon nanotubes which require spatial alignment beside their high cost Home electric furnaces: Current gas furnaces can be modified or replaced with more efficient and less polluting electric heating sources using our conductive surface heating element. Current electric furnaces use electric heating coils as the source of heat, instead of burning gas or oil. However, coils are small and therefore not highly efficient despite their large consumption of electric energy. The increased surface area of the painted heaters can enhance the overall thermal delivery of heat to the air in furnaces. Moreover, the surface heater can be painted directly on the heat exchanger of existing gas furnaces and therefore enhance their efficiency by reducing their thermal resistance.

A heating device including a substrate, at least one heating layer on the substrate, and a power supply electrically connected to the at least one heating layer. The heating layer includes graphene nanomaterials. To form a layer of heating material, a liquid including graphene nanomaterials is applied to the substrate. The liquid is dried to form the at least one heating layer on the substrate. A first electrode and a second electrode are attached to the substrate. A power supply is electrically connected to the at least one heating layer on the substrate via the first electrode and the second electrode. The heating layer produces heat in the presence of power applied to the electrodes. The graphene nanomaterials, such as graphene nanoparticles, in the heating layer dissipate the electricity in the heating layer in response to the application of power to the heating layer. In some embodiments, a plurality of heating layers are applied to the substrate to form the heating device. In still further embodiments, the resistance between the first electrode and the second electrode is measured after the application of the heating layer. In some embodiments, additional heating layers are applied until a desired resistance between the first electrode and the second electrode is achieved. The heating device, in some example embodiments, includes a first electrode coupled to the at least one heating layer on the substrate, and a second electrode coupled to the at least one heating layer on the substrate at a location remote from the first electrode.

In some embodiments, the power source for the heating device is a DC (direct current) power source. In other embodiments, the power source for the heating device is an AC (alternating current) power source.

The liquid including the graphene nanomaterials or graphene nanoparticles can be a paint or an ink. The ink is capable of being printed onto the substrate. The graphene nanomaterials can include graphene nano-platelets, in one embodiment. In another embodiment, the graphene nanomaterials can include graphene oxide nano-platelets. In still other example embodiments, the graphene nanomaterials include edge-functionalized graphene nano-platelets.

In one example embodiment, the substrate of the heating devices made of glass, a dielectric material, an electrically isolated material, a polymer material, or the like.

The heating device, in still another embodiment, includes a cover layer covering the heating layer. The heating layer is sandwiched between the electrically insulating substrate and the cover layer. In another example embodiment, a heating layer is sandwiched between moisture insulating substrate and the cover layer.

A method of forming a heating device includes suspending an amount of graphene nano-platelets in a liquid, sonicating the liquid, and spreading the liquid and graphene nano-platelet mixture on a substrate as a film. The substrate includes a first electrode and a second electrode spaced away from the first. The liquid and graphene nano-platelet mixture is dried. The resistance between the first electrode and the second electrode is measured. In some embodiments, the spreading and drying spreading of the liquid and graphene nano-platelet mixture on a substrate are repeated. The resistance between the electrodes is measured. The spread and drying can be continued until a predetermined final resistance between the first electrode and the second electrode is reached. In one embodiment, the amount of suspended nano-platelets is in a range of 0.1% to 1% graphene nano-platelets by weight. In another example embodiment, amount of suspended platelets is varied to vary the final resistance, and the amount of heating of the heating device. The foregoing description of the specific embodiments reveals the general nature of the invention sufficiently that others can, by applying current knowledge, readily modify and/or adapt for various applications without departing from the concept, and therefore such adaptations and modifications are intended to be comprehended within the meaning and range of equivalents of the disclosed embodiments.

It is to be understood that the phraseology or terminology employed herein is for the purpose of description and not of limitation. Accordingly, the invention is intended to embrace all such alternatives, modifications, equivalents and variations as fall within the spirit and broad scope of the appended claims.

The invention claimed is:

1. A heating device comprising;

a substrate;

a liquid including graphene nanomaterials applied to the substrate and allowed to dry to form at least one heating layer on the substrate; and a power supply electrically connected to the at least one heating layer on the substrate, the heating layer producing heat in the presence of power, the graphene nanoparticles in the heating layer dissipating the electricity in the heating layer in response to the application of power to the heating layer.

2. The heating device of claim 1 wherein the heating layer is comprised of a plurality of layers.

3. The heating device of claim 1 further comprising;

a first electrode coupled to the at least one heating layer on the substrate; and a second electrode coupled to the at least one heating layer on the substrate at a location remote from the first electrode.

4. The heating device of claim 1 wherein the power source is a DC (direct current) power source.

5. The heating device of claim 1 wherein the power source is an AC (alternating current) power source.

6. The heating device of claim 1 wherein the liquid including the graphene particles is a paint.

7. The heating device of claim 1 wherein the liquid including the graphene particles is an ink capable of being printed onto the substrate.

8. The heating device of claim 1 wherein the graphene nanomaterials include graphene nano-platelets.

9. The heating device of claim 1 wherein the graphene nanomaterials include graphene Oxide nano-platelets.

10. The heating device of claim 1 wherein the graphene nanomaterials include edge-functionalized graphene nano-platelets.

11. The heating device of claim 1 wherein the substrate is made of glass.

12. The heating device of claim 1 wherein the substrate is made of a dielectric material.

13. The heating device of claim 1 wherein the substrate is made of an electrically isolated material.

14. The heating device of claim 1 wherein the substrate is made of a polymer material.

15. The heating device of claim 1 further comprising a cover layer covering the heating layer.

16. The heating device of claim 15 wherein the heating layer is sandwiched between the electrically insulating substrate and the cover layer.

17. The heating device of claim 15 wherein the heating layer is sandwiched between moisture insulating substrate and the cover layer.

18. A method of forming a heating device comprising:

suspending an amount of graphene nano-platelets in a liquid;

sonicating the liquid;

spreading the liquid and graphene nano-platelet mixture on a substrate as a film, the substrate including a first electrode and a second electrode spaced away from the first; and drying the liquid and graphene nano-platelet mixture;

repeating the spreading and drying, until reaching predetermined final resistance between the first electrode and the second electrode.

19. The method of claim 17 wherein the amount of suspended nano-platelets is in a range of 0.1% to 1% graphene nano-platelets by weight.

20. The method of claim 17 wherein the amount of suspended nano-platelets is varied to vary the final resistance, and the amount of heating of the heating device.

* * * * *